US006731060B1

(12) United States Patent
Yamamoto et al.

(10) Patent No.: US 6,731,060 B1
(45) Date of Patent: May 4, 2004

(54) ELECTRON-EMITTING DEVICE, ELECTRON SOURCE USING THE ELECTRON-EMITTING DEVICE, AND IMAGE-FORMING APPARATUS USING THE ELECTRON SOURCE

(75) Inventors: Keisuke Yamamoto, Yamato; Tamaki Kobayashi, Isehara; Satoshi Mogi, Kawasaki, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/513,136

(22) Filed: Feb. 25, 2000

(30) Foreign Application Priority Data

Feb. 26, 1999 (JP) ..... 11-052028
Feb. 15, 2000 (JP) ..... 2000-041451

(51) Int. Cl.[7] ..... H01J 1/62
(52) U.S. Cl. ..... 313/495; 313/336; 313/310
(58) Field of Search ..... 313/495, 496, 313/497, 320, 336, 351, 238, 292, 243, 240, 250, 609, 610, 621

(56) References Cited

U.S. PATENT DOCUMENTS 5,470,265 A 11/1995 Nomura et al. ..... 445/24
5,530,314 A * 6/1996 Banno et al. ..... 313/310
5,578,897 A 11/1996 Nomura et al. ..... 313/310
5,747,918 A 5/1998 Eom et al. ..... 313/309
5,777,427 A 7/1998 Tanaka et al. ..... 313/309
6,208,071 B1 * 3/2001 Nishimura et al. ..... 313/495

FOREIGN PATENT DOCUMENTS

| | | |
|---|---|---|
| EP | 0 660 357 | 6/1995 |
| JP | 7-235255 | 9/1995 |
| JP | 2854385 | 11/1998 |

OTHER PUBLICATIONS

H. Araki, "Electroforming and Electron Emission of Carbon Thin Films", Journal of the Vacuum, Society of Japan, 1983, pp. 22–29 (with English Abstract on p. 22).
M. Hartwell, "Strong Electron Emisson from Patterned Tin–Indium Oxide Thin Films", IEDM, 1975, pp. 519–521.

* cited by examiner

*Primary Examiner*—Sandra O'Shea
*Assistant Examiner*—Bao Q. Truong
(74) *Attorney, Agent, or Firm*—Fitzpatrick, Cella, Harper & Scinto

(57) ABSTRACT

Disclosed is an electron-emitting device constructed by a pair of electroconductors which are disposed so as to be opposite to each other on a substrate and a pair of deposited films which are arranged so as to be connected to the pair of electroconductors, which are disposed so as to sandwich a gap, and which contain carbon as a main component. In each of the deposited films, phosphorus is contained in a range of 5 mol percent to 15 mol percent with respect to carbon.

17 Claims, 9 Drawing Sheets

ELECTRON-EMITTING DEVICE, ELECTRON SOURCE USING THE ELECTRON-EMITTING DEVICE, AND IMAGE-FORMING APPARATUS USING THE ELECTRON SOURCE

BACKGROUND OF THE INVENTION

1. Field of the Invention

The present invention relates to an electron-emitting device, an electron source comprising it, and an image-forming apparatus such as a display as its application. More particularly, the invention relates to a surface conduction electron-emitting device with a novel construction, an electron source using it, and an image-forming apparatus such as a display as its application.

2. Related Background Art

A surface conduction electron-emitting device utilizes a phenomenon that electrons are emitted by allowing an electric current to flow into an electroconductive film formed on a substrate.

As an example of the surface conduction electron-emitting device, the use of an $SnO_2$ thin film for a device of this type [M. I. Elinson, "Radio Eng. Electron Phys.", 10, 1290, (1965)], the use of an Au thin film [G. Ditmmer, "Thin Solid Films", 9, 317 (1972)], the use of an $In_2O_3/SnO_2$ thin film [M. Hartwell and C. G. Fonsted, "IEEE Trans. ED Conf.", 519 (1975)], the used of a carbon thin film [Hisashi Araki et al., "Shinku (Vacuum)", Vol. 26, No. 1, p. 22 (1983)], and the like have been reported.

In the above surface conduction electron-emitting device, prior to emitting electrons, the electroconductive film is generally subjected to an energization operation called "forming", thereby obtaining a state where the electron emission is caused.

In this instance, "forming" is such an operation that a constant voltage or a voltage which gradually rises at a rate of, for example, about 1 V/min. is applied across the electroconductive film to allow a current to flow into the electroconductive film, and the electroconductive film is partially broken, deformed, or modified to enter an electrically high-resistant state, thereby obtaining a state where electrons are emitted.

Owing to the operation, a fissure is formed in a part of the electroconductive film. The phenomenon of the electron emission is attributed to the presence of the fissure. Although it is not completely clarified which portion the electron emission actually occurs in the fissure and a region around it are called "electron emitting portion" for convenience in some cases.

The present applicant has already expressed many proposals regarding the surface conduction electron-emitting device. For instance, the applicant has disclosed that it is preferable to perform the above "forming" by applying a pulse voltage to the electroconductive film in Japanese Patent No. 2854385 and U.S. Pat. Nos. 5,470,265 and 5,578,897.

In this instance, a waveform of the pulse voltage can be obtained by either one of a method of holding a peak value constant as shown in FIG. 5A and a method of gradually raising a peak value as shown in FIG. 5B. In consideration of the form and material of the device and forming conditions, it can be suitably selected.

It is found that subsequent to the forming, the pulse voltage is repetitively applied to the electron-emitting device in an atmosphere containing an organic material, so that both of a current (device current If) flowing into the device and a current (emission current Ie) accompanying with the electron emission increase. Such an operation is called "activation".

The operation forms a deposit containing carbon as a main component in the region including the fissure formed by the "forming" in the electroconductive film. The details of the operation are disclosed in Japanese Patent Application Laid-Open No. 7-235255.

When the above surface conduction electron-emitting device as mentioned above is applied to an image-forming apparatus, it is further required that the device has a low electric consumption and high luminance.

As properties of the electron-emitting device, therefore, it is required to further raise a ratio of the emission current Ie to the device current If, namely, an electron-emitting efficiency more than ever.

It is a matter of course that when such properties are improved, it is necessary that an aging change in properties by continuing the electron emission is not larger than that of the conventional technique.

SUMMARY OF THE INVENTION

It is an object of the present invention to provide an electron-emitting device excellent in electron-emitting characteristics, an electron source using it, and an image-forming apparatus using it.

According to the present invention, there is provided an electron-emitting device comprising a pair of electroconductors disposed on a substrate so as to be opposite to each other; and a pair of deposited films which are arranged so as to be connected to the pair of electroconductors, respectively, and which are disposed so as to sandwich a gap, and which contain carbon as a main component, wherein in the deposited film, phosphorus is contained within a range of 5 mol percent to 15 mol percent with respect to carbon.

According to the present invention, there is provided an electron-emitting device comprising a pair of device electrodes arranged so as to be opposite to each other on a substrate, an electroconductive film which is arranged so as to be connected to the pair of device electrodes and which has a fissure between the pair of device electrodes, and a deposit which is formed in the fissure and a region including the fissure, which has a gap with a width that is narrower than the fissure in the fissure, and which contains carbon as a main component, wherein in the deposit, phosphorus is contained within a range of 5 mol percent to 15 mol percent with respect to carbon.

DETAILED DESCRIPTION OF THE PREFERRED EMBODIMENTS

Figure 1A:
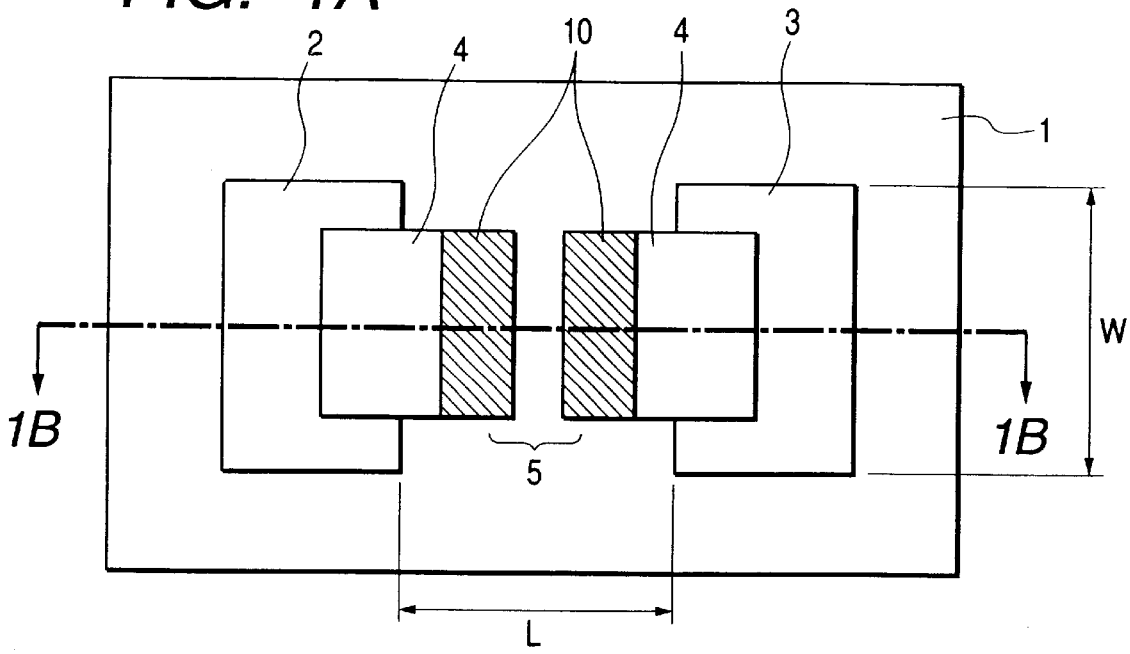
FIGS. 1A and 1B are schematic views showing a schematic construction of an electron-emitting device according to a practical mode of the present invention.

According to the present invention, in an electron-emitting device comprising a pair of electroconductors which are arranged so as to be opposite to each other on a substrate; and a pair of deposited films which are arranged so as to be connected to the pair of electroconductors, respectively, which are disposed so as to sandwich a gap, and which contain carbon as a main component, each of the deposit films contains phosphorus within a range of 5 mol percent to 15 mol percent with respect to carbon.

According to the present invention, in an electron-emitting device comprising: a pair of device electrodes arranged so as to be opposite to each other on a substrate; an electroconductive film which is arranged so as to be connected to the pair of device electrodes and which has a fissure between the pair of the device electrodes; and a deposit which is formed in the fissure and a region including the fissure, which has a gap having a width that is narrower than the fissure in the fissure, and which contains carbon as a main component, the deposit contains phosphorus within a range of 5 mol percent to 15 mol percent with respect to carbon.

According to the present invention, there is provided an electron source comprising a plurality of the above electron-emitting devices arranged on a substrate and wirings which are connected to the electron-emitting devices.

According to the present invention, there is provided an image-forming apparatus comprising the above electron source and an image-forming member for forming images due to collision of electrons emitted from the electron source.

Preferred practical modes of the present invention will now be illustratively described in detail by referring to the drawings. The dimension, material, form, relative arrangement, and the like of each of constitutional members which will be described in the practical modes never intend to limit the scope of the invention unless otherwise specified.

Figure 1B:
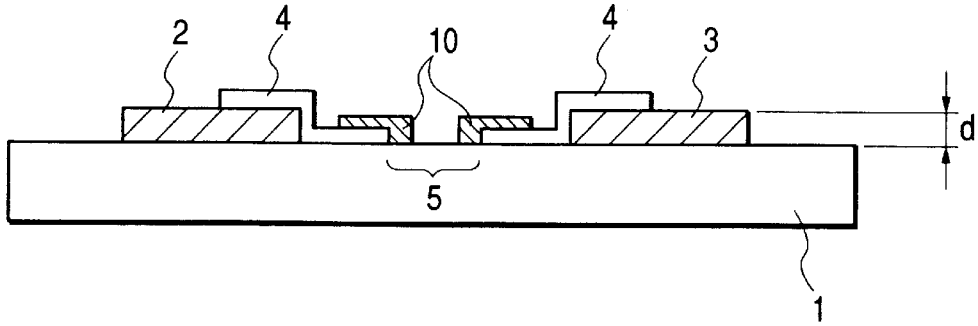

Referring to FIGS. 1A and 1B, a fundamental construction of an electron-emitting device according to a practical mode of the present invention will now be described. FIGS. 1A and 1B are schematic views illustrating a schematic construction of the electron-emitting device according to the practical mode of the present invention. FIG. 1A is a schematic plan view. FIG. 1B is a sectional schematic view (cross-sectional view taken along the line 1B—1B in FIG. 1A).

In FIGS. 1A and 1B, on a substrate 1 as a base made of an insulating material, a pair of device electrodes 2 and 3 arranged so as to be opposite to each other are provided. An electroconductive film 4 arranged so as to be connected to the pair of device electrodes 2 and 3 is formed.

The illustration shows a case where an electroconductors is constructed by the device electrodes 2 and 3 and the electroconductive film 4 as mentioned above. Even when the electroconductive film 4 is eliminated and the electroconductor is constituted by the device electrodes 2 and 3 only, the electroconductor can exhibit the similar function as an electron-emitting device.

Referring to FIGS. 1A and 1B, reference numeral 5 schematically denotes a fissure formed in the electroconductive film 4. The fissure 5 is formed between the pair of device electrodes 2 and 3.

Referring to FIGS. 1A and 1B, a deposit (deposited film) 10 contains carbon as a main component. In this case, the deposit 10 in the illustration is formed on the electroconductive film 4 alone. Depending on a forming method, it is also formed on the device electrodes 2 and 3. It is also formed on the substrate 1 except for the inside region of the fissure 5 in some cases.

The deposit 10 containing carbon as a main component is formed not only around the fissure 5 but also in the fissure 5. The deposit 10 is formed in the fissure 5 so as to have a gap that is narrower than the fissure 5.

Figure 2:
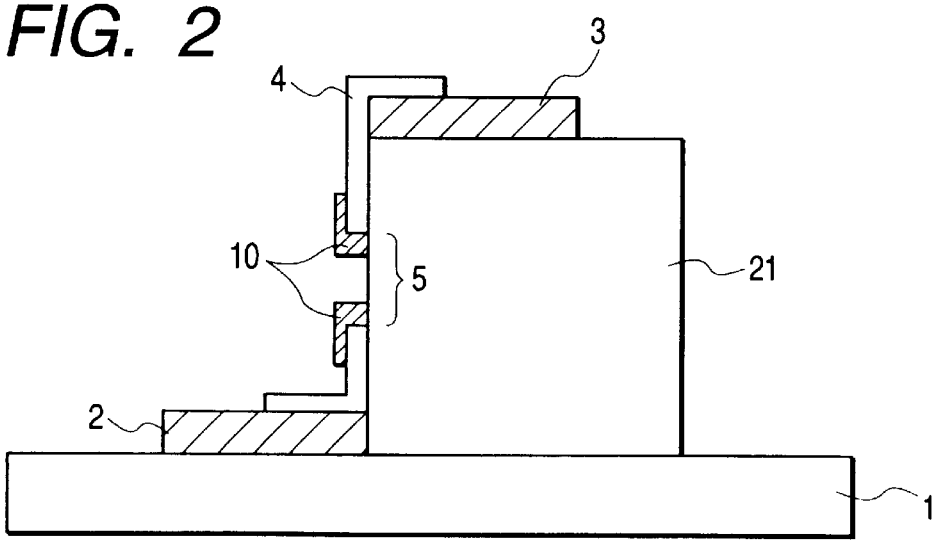
FIG. 2 is a schematic cross-sectional view of the electron-emitting device according to the practical mode of the present invention.

As another fundamental construction of the electron-emitting device, there is a step type device shown in FIG. 2. FIG. 2 is a schematic cross-sectional view of the electron-emitting device according to the practical mode of the present invention.

Referring to FIG. 2, a step-forming member 21 made of an insulating material is formed on the substrate 1 in order to form a step. Except for the member 21, the fundamental construction is the same as that shown in FIGS. 1A and 1B and the component elements are designated by the same reference numerals.

As required properties of the device electrodes 2 and 3, it is necessary to have enough electroconductive properties. As a material, metal, alloy, or electroconductive metallic oxide, or a printed conductor or semiconductor made from a mixture of the above material and glass or the like are mentioned.

In order to preferably form a fissure due to the forming, namely, preferably impart electron-emitting ability, it is preferable to form the electroconductive film 4 by using fine particles made of an electroconductive material. As a material, for example, an electroconductive material such as Nj, Au, PdO, Pd, or Pt can be used.

Among them, PdO is preferably used because of the following advantages. After an organic Pd composition film is formed, it is baked in an atmosphere, so that an electroconductive film comprising fine particles can be easily formed. Since the film is a semiconductor, it has an electric conductivity that is relatively lower than that of metal, it can be easily controlled so as to obtain a proper resistance value for the forming, and it can be relatively easily reduced. Consequently, after the fissure is formed due to the forming operation, the film is brought into metallic Pd, so that the resistance can be reduced.

The deposit 10 containing carbon as a main component can be formed by the above-mentioned "activation" method.

For controlling a content of phosphorus (hereinbelow, referred to as P) contained in the deposit 10 containing carbon as a main component, there can be used a method of introducing a raw gas containing P to an atmosphere containing an organic material during activation to control its amount, or a method of forming a deposit, applying a solvent containing P in a form of an organic metallic composition or the like to the deposit, performing a heat treatment to allow the deposit to contain P, and to thereby control the amount of the applied solvent.

According to the examination by the present inventor et al., it was clarified that when P of 5 mol percent or more was contained with respect to carbon, such an effect that an electron-emitting efficiency raised was found.

On the other hand, it turned out that when the content was too much, in the case where the electron-emission was successively performed, a decreasing speed of the emission current became faster than that in the case where P was not contained (namely, the stability is deteriorated). As for the problem, the present inventor et al. also found that when the content of P was 15 mol percent or less with respect to carbon, a serious influence was not actually exerted to the stability, so that the present invention was accomplished.

Although the reason is not sufficiently seized, it is found that at least part of the deposit containing carbon as a main component has a graphite structure. It is well known that when P is contained in graphite, the electroconductive properties are improved. The present inventors infer that such a fact advantageously operates upon improvement of the electron-emitting efficiency. For the reason why an increase in content causes a serious influence on stability, the present inventors infer that it is concerned with a decrease in crystallinity of the portion with the graphite structure.

Subsequently, a more specific embodiment constructed on the basis of the practical mode of the present invention will now be described.

(Embodiment of Electron-emitting Device)

An electron-emitting device according to the present embodiment has the same construction as that shown in FIGS. 1A and 1B.

A method of manufacturing the electron-emitting device according to the present embodiment will now be explained with respect to FIGS. 1A and 1B and 3A to 3D.

(Process-a)

First, on a cleaned quartz substrate 1, a photoresist pattern is formed so as to have openings corresponding to the forms of the device electrodes 2 and 3. By a vacuum evaporation method, Ti is deposited at a thickness of 5 nm and Pt is subsequently deposited at a thickness of 30 nm on it.

Figure 3A:
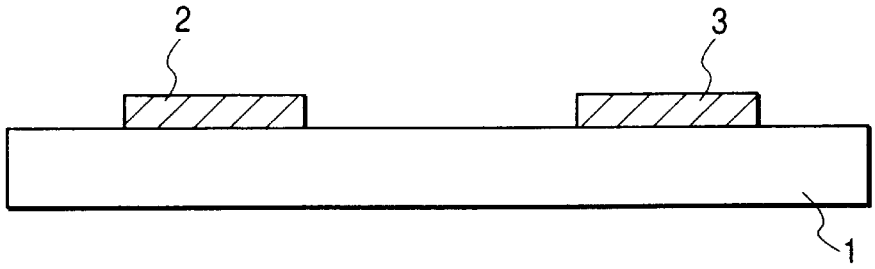
FIGS. 3A, 3B, 3C and 3D are views for explaining a manufacturing process of the electron-emitting device according to an embodiment of the present invention.

The photoresist pattern is resolved and eliminated by an organic solvent. By a lift-off method, electrodes made of a Pt/Ti deposited film are formed. In this instance, an electrode interval L is set to 50 $\mu$m and an electrode width W is set to 300 $\mu$m (FIG. 3A).

(Process-b)

A Cr film is formed at a thickness of 100 nm by the vacuum evaporation method. The Cr film is patterned so as to have an opening corresponding to the form of an electroconductive film, which will be described hereinlater, by a photolithography method. After that, a solvent of an organic Pd composition (ccp4230 manufactured by Okuno Pharmaceutical Industries Co., Ltd.) is applied to the resultant film by using a spinner. After the film coated with the solvent is dried, it is subjected to a heat treatment at a temperature of 350° C. in an atmosphere for 12 minutes.

An electroconductive film comprising PdO fine particles with a thickness of 10 nm by the above process. A sheet resistance Rs of the film is equal to $2\times10^4$ Ω/□.

When it is assumed that when a resistance value measured by supplying a current to the film having a length l and a width w in the longitudinal direction is set to R, the sheet resistance Rs is expressed by the following equation.

$$R=(l/w)Rs$$

In the case where the film is uniform, when it is assumed that a resistivity is set to ρ and a film thickness is set to t, the sheet resistance Rs is expressed by the following equation.

$$Rs=\rho/t$$

(Process-c)

Figure 3B:
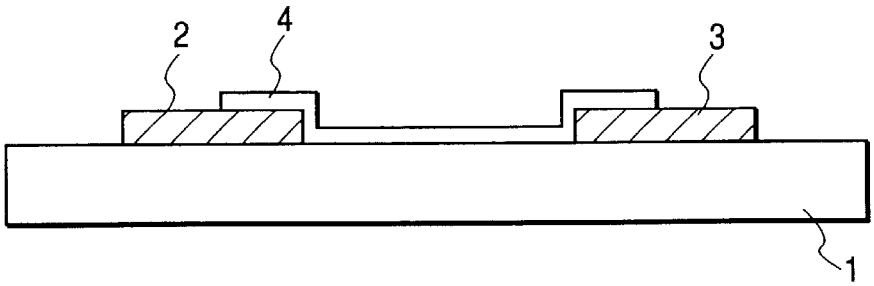

The Cr film is removed by a Cr etchant. The electroconductive film is patterned into a desired form by the lift-off method (FIG. 3B).

(Process-d)

Figure 3C:
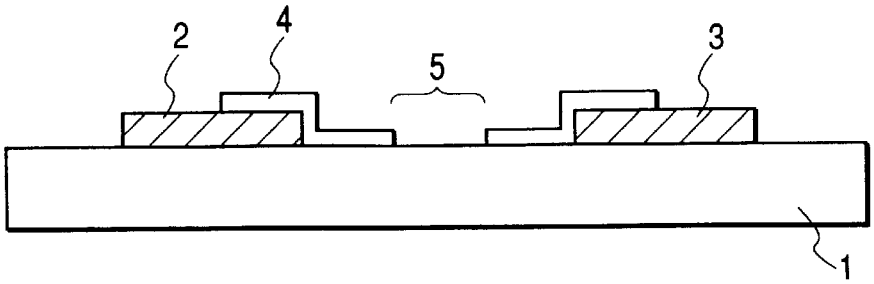

The device is set in a vacuum processing apparatus. A pressure in a vacuum chamber is decreased to $2.7\times10^{-4}$ Pa by an exhaust apparatus. After that, a pulse voltage is applied to a portion between the device electrodes 2 and 3 to perform the forming operation, thereby forming the fissure 5 in a part of the electroconductive film (FIG. 3C).

Figure 5A:
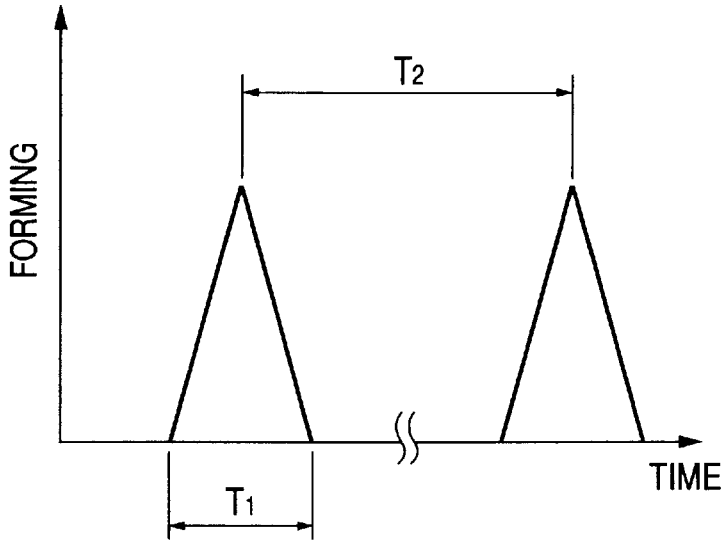
FIGS. 5A and 5B are pulse voltage waveform chart which is used in a forming process when the electron-emitting device according to the embodiment of the present invention is formed.
Figure 5B:
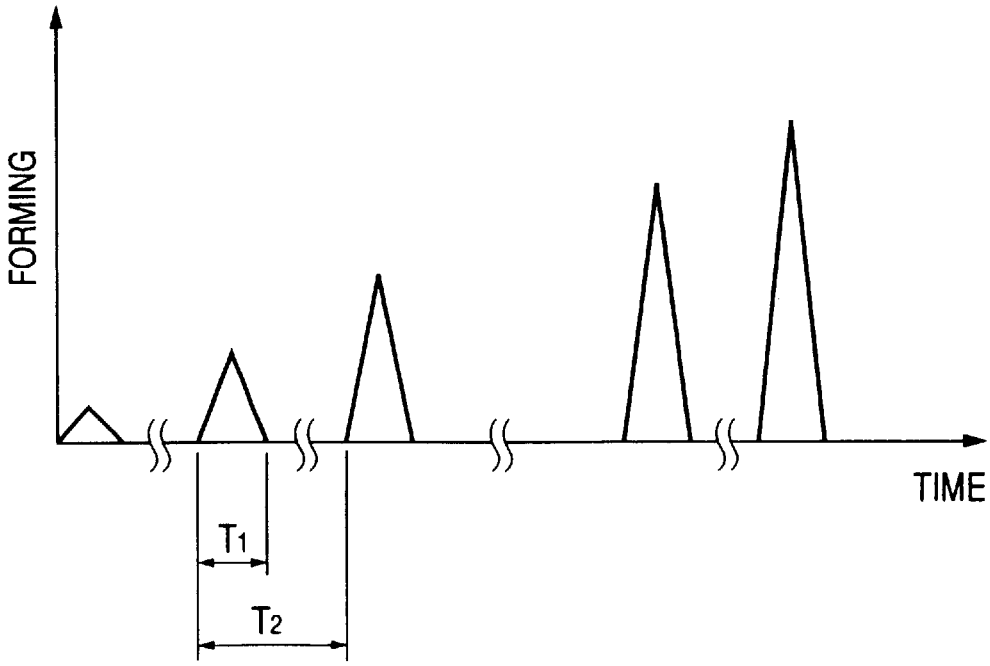

The waveform of the pulse voltage used for the forming operation is shown in FIG. 5B. The process is performed under such conditions that a pulse width T1 is equal to 1 msec., a pulse interval T2 is equal to 10 msec, and a peak value is gradually increased at a rate of 0.1V per step.

During the process, a rectangular pulse voltage having a peak value of 0.1V is inserted between the above pulse voltages and current values are measured, thereby obtaining the resistance value of the device. When the resistance value obtained as mentioned above exceeds 1 MΩ, applying the pulse voltage is stopped and the forming operation is finished.

(Process-e)

Subsequently, the activation operation is performed. Exhausting the vacuum chamber is continued. After the pressure in the chamber is dropped to $1.3\times10^{31\ 6}$ Pa, a mixture of benzonitrille and trimethylphosphoric acid is introduced to the chamber through a slow leak valve attached to the vacuum chamber. The slow leak valve is controlled so that the partial pressure of benzonitrille is equal to $1.3\times10^{-4}$ Pa. Controlling the ratio of benzonitrille to trimethylphosphoric acid can control the content of P contained in the deposit containing carbon as a main component, which is formed in the activation operation.

Figure 10:
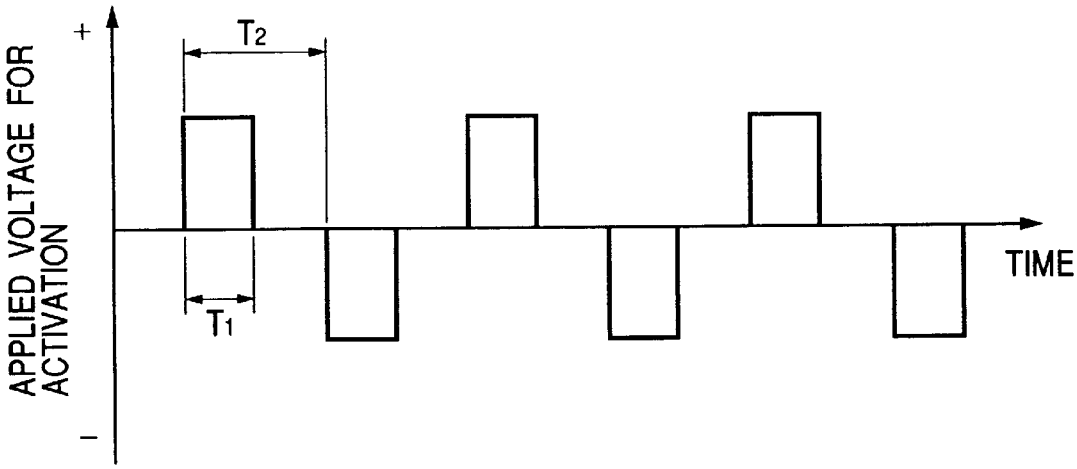
FIG. 10 is a pulse voltage waveform chart which is used in an activation process when the electron-emitting device according to the embodiment of the present invention is formed.

The pulse voltage is applied to the portion between the device electrodes 2 and 3. The waveform of the applied pulse voltage is a rectangular pulse as shown in FIG. 10, whose polarity is inversed every pulse. The pulse voltage is applied for 60 minutes under such conditions that the pulse width T1 is equal to 1 msec., pulse interval T2 is equal to 100 msec., and peak value of the pulse voltage is set to 15V. (Pulse applying time is obtained as time until increasing the device current If is saturated under such processing conditions by a preliminary examination.)

Figure 3D:
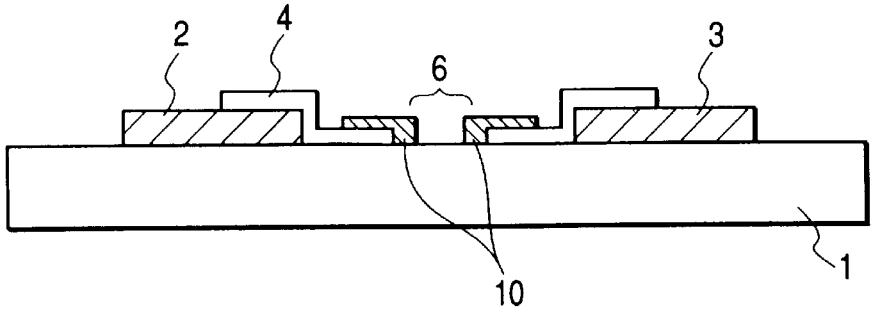

In the region including the fissure 5 formed in the electroconductive film by the process, the deposit 10 containing carbon as a main component is formed. The deposit 10 containing carbon as a main component is deposited in the fissure 5 so as to form a gap 6 that is narrower than the fissure 5 (FIG. 3D).

In this manner, there were formed a sample containing P of 5 mol percent in the ratio to carbon (embodiment 1), one containing P of 9 mol percent (embodiment 2), one containing P of 15 mol percent (embodiment 3), and one containing P of 18 mol percent (comparative example 2). Further, a sample to which P was not added (comparative example 1) was also prepared for comparison.

Since a relation between the ratio of benzonitrile to trimethylphosphoric acid and the content of P contained in the deposit containing carbon as a main component varied depending on the vacuum apparatus or conditions for the activation operation, the relation was obtained by the preliminary examination and the conditions at that time were applied. At that time, the content of P was measured by a photoelectron spectroscopy method. An apparatus used was ESCA LAB 220I-XL manufactured by VG Scientific Co., Ltd.

In the measurement, the ratio of P/C was obtained from the 2p peak of P and the 1s peak of C (carbon) observed in a region in which each side was equal to 50 $\mu$m around the fissure as a center. The measurement limit of P under such conditions was equal to about 0.1 mol percent.

(Process-f)

The vacuum chamber is exhausted and the vacuum chamber and device are held at 250° C. for 10 hours. The operation is performed in order to eliminate water and molecules of the organic material adsorbed to the device or inside of the vacuum chamber. The operation is called a "stabilization operation".

Figure 4:
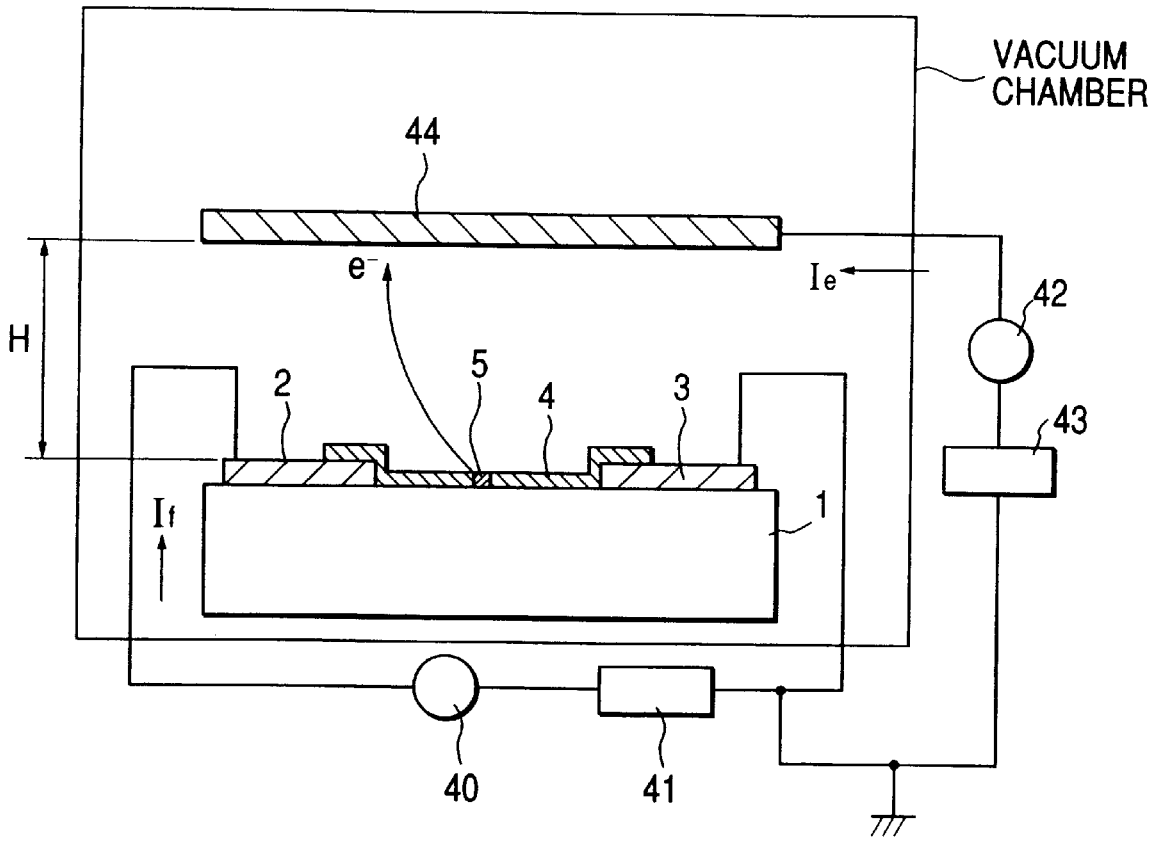
FIG. 4 is a block diagram showing the outline of an evaluating apparatus for the electron-emitting device according to the embodiment of the present invention.

As for the device, electron-emitting characteristics and its aging change were measured by using the apparatus whose outline was shown in FIG. 4.

Namely, a rectangular pulse voltage having a pulse width of 1 msec., a pulse interval of 100 msec., and a peak value of 15 V was applied to the device by a pulse generator 41. A distance H between the device and an anode electrode 44 was set to 4 mm. A constant voltage of 1 kV was applied to the anode electrode 44 by a high-voltage power source 43. At that time, the device current If was measured by an ammeter 40 and the emission current Ie was measured by an ammeter 42 to obtain an electron-emitting efficiency $\eta$=(Ie/If).

It was found that when the device was continuously driven, both of Ie and If gradually decreased and, when the content of P was increased to some degree, the decrease of Ie and If became faster than that of a case where P was not contained. The comparison of values of the electron-emitting efficiency at the beginning of the measurement and the situation of the decrease of Ie and If are shown in the following TABLE 1.

TABLE 1

| | Comparative example 1 | Embodiment 1 | Embodiment 2 | Embodiment 3 | Comparative example 2 |
|---|---|---|---|---|---|
| P/C(mol %) | 0 | 5.0 | 9.0 | 15.0 | 18.0 |
| $\eta$ (%) | 0.12 | 0.15 | 0.16 | 0.17 | 0.17 |
| Aging change | — | ○ | ○ | ○ | x |

In TABLE 1, symbol ○ denotes that the situation of the decrease of Ie and If is not different from that of the sample containing no P (comparative example 1) and symbol × denotes that the decrease of Ie and If is faster than that of the comparative example 1.

As a result, it turned out that when the deposit containing carbon as a main component contained P of 5 to 15 mol percent, the electron-emitting efficiency was raised and, as compared with the case where such atoms were not contained, a change in Ie and If due to the aging change was not increased, so that preferable results were obtained.

(Embodiment of Electron Source and Image-forming Apparatus)

A plurality of electron-emitting devices according to the practical modes or embodiments of the present invention are arranged on the substrate and wirings which are connected to the devices are formed, so that an electron source can be formed.

Figure 6:
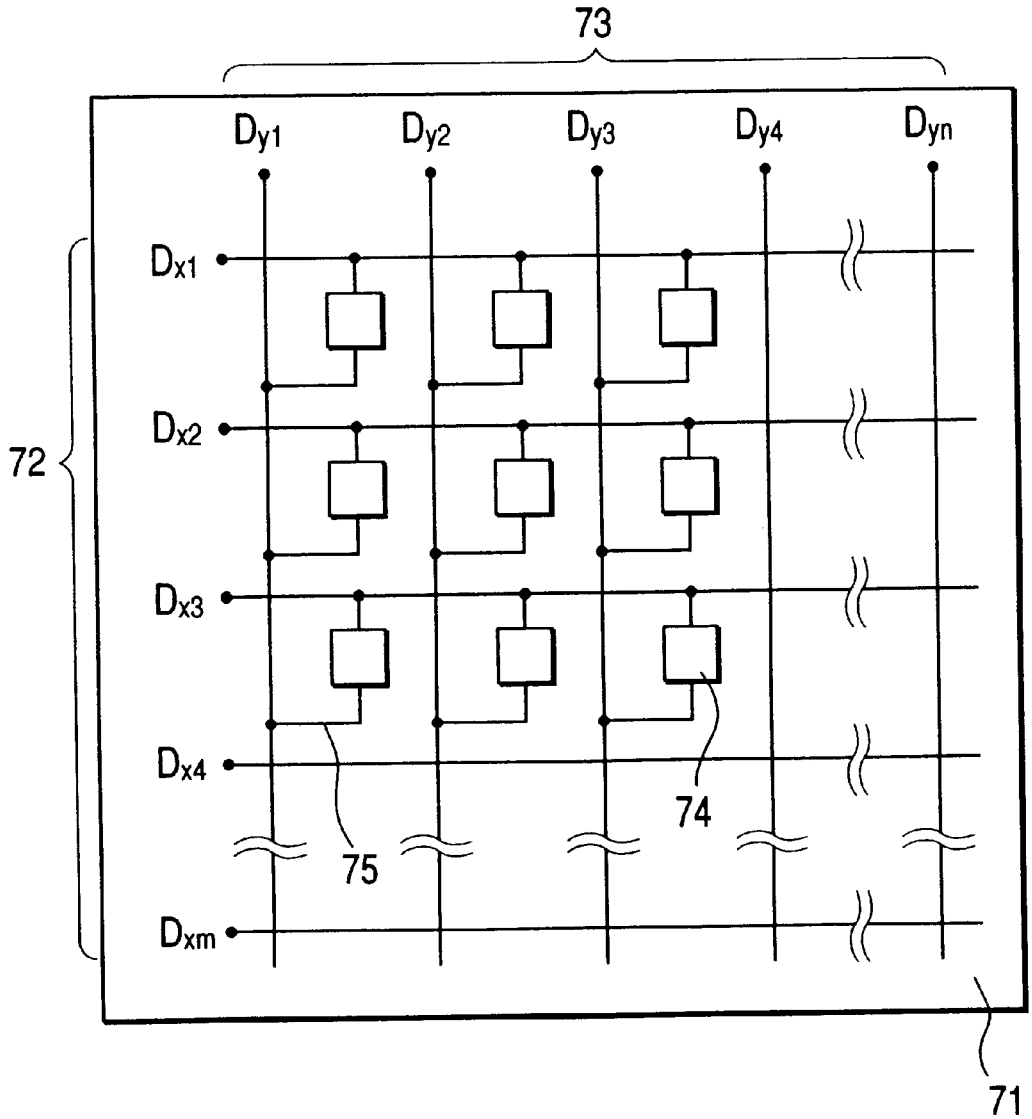
FIG. 6 is a schematic diagram of an electron source according to the embodiment of the present invention.

FIG. 6 shows a constructional example. In the diagram, reference numeral 71 denotes a substrate; 72*m* X-directional wirings Dx1 to Dxm; 73*n* T-directional wirings Dy1 to Dyn; 74 an electron-emitting device according to the practical modes or embodiments of the present invention; and 75 a connection for connecting the wiring and the device. An insulating layer (not shown) is arranged on the intersection of the X-directional wiring and the Y-directional wiring so as to electrically insulate both of them from each other.

An image-forming apparatus can be constituted by the above electron source and an image-forming member for forming images by irradiating electrons emitted from the electron source.

Figure 7:
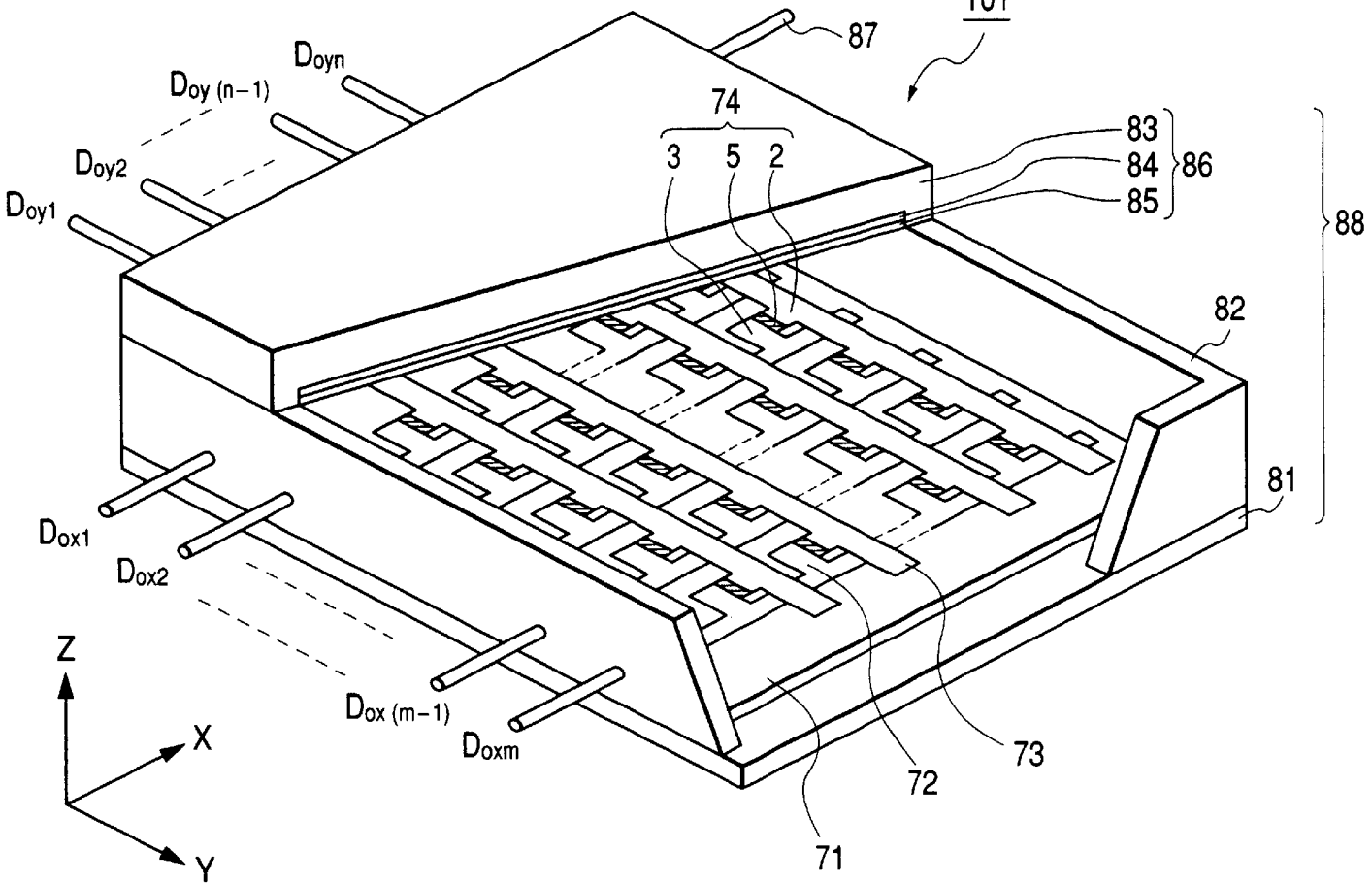
FIG. 7 is a schematic partially cutaway cross-sectional view in perspective of an image-forming apparatus utilizing the electron source shown in FIG. 6.

FIG. 7 shows a constructional example. In the diagram, an envelope 88 is constructed by a rear plate 81, a supporting frame 82, a glass substrate 83, and a face plate 86. The above-mentioned electron source is disposed in the envelope 88. The inside of the envelope 88 can be sealed airtight.

External terminals Dox1 to Doxm and Doy1 to Doyn are connected to the X-directional wirings Dx1 to Dxm and the Y-directional wirings Dy1 to Dyn. Reference numeral 84 denotes an image-forming member 84 made from phosphor or the like. A metal back 85 made of a metallic deposited film reflects light, which is emitted from the image-forming member 84 to the inside of the envelope 88, to the outside to improve a luminance and serves as an anode electrode for accelerating electrons emitted from the electron source.

A high-voltage terminal 87 which is connected to the metal back 85 is connected to a power source for applying a high voltage to the metal back (anode electrode) 85.

In the illustration shown in FIG. 7, the rear plate 81 is provided separately from the substrate 71 for the electron source. When the substrate 71 has enough strength, it can be also used as a rear plate.

Figure 8:
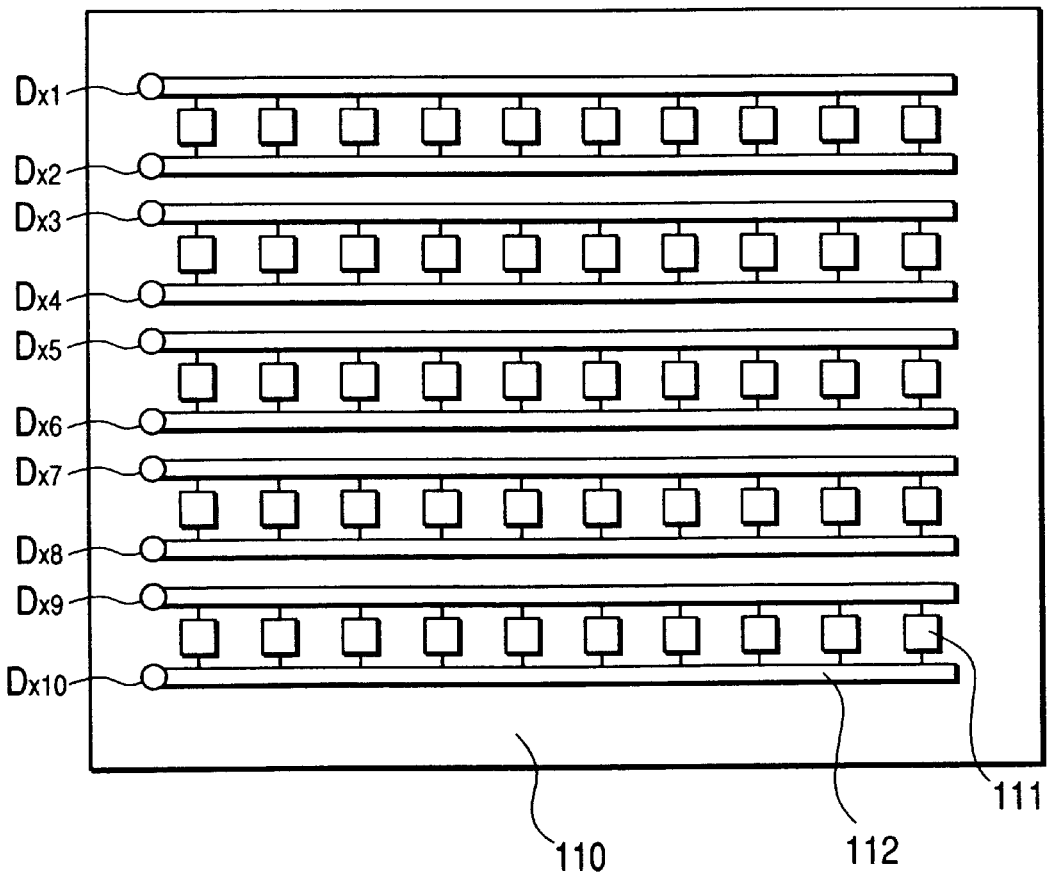
FIG. 8 is a schematic diagram showing another construction of the electron source according to the embodiment of the present invention.

As a construction of the electron source, a construction shown in FIG. 8 can be used. That is, a plurality of wirings 112 are formed in parallel on a substrate 110. A plurality of electron-emitting devices 111 are arranged between a pair of wirings to form a plurality of device rows.

Figure 9:
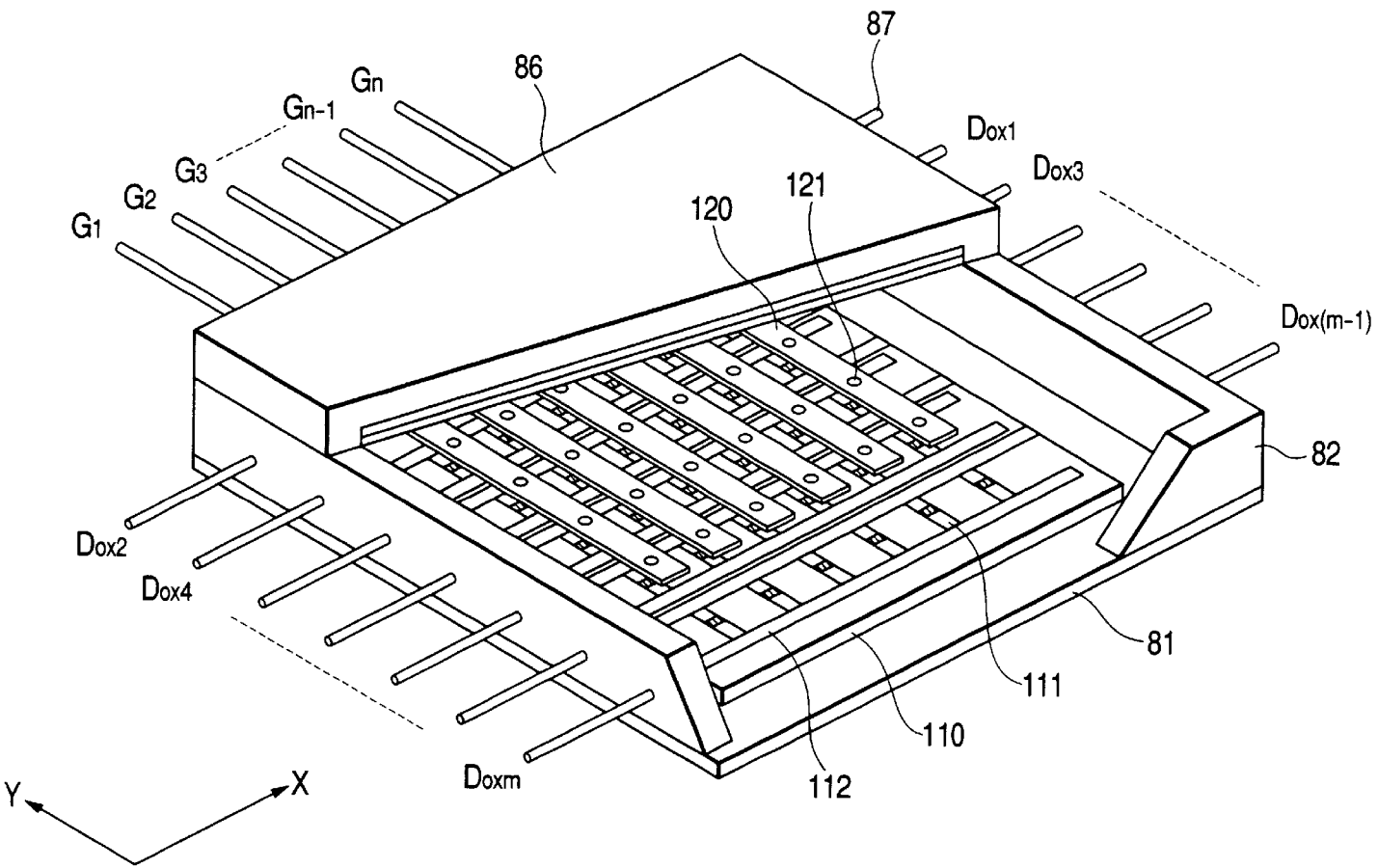
FIG. 9 is a schematic partially cutaway cross-sectional view in perspective of an image-forming apparatus utilizing the electron source shown in FIG. 8.

FIG. 9 shows a constructional example of the image-forming apparatus utilizing the electron source with such a construction. In case of such a construction, a plurality of grid electrodes 120 extending in the direction perpendicular to the direction of the device rows of the electron source are arranged and have a function to modulate an electron beam emitted from the electron-emitting device belonging to one row selected from among the device rows by a driving circuit.

Each grid electrode has an electron pass hole 121 to allow electrons to pass at a position corresponding to the electron-emitting device.

The external terminals Dox1 to Doxm are connected to the wirings. FIG. 9 shows a case where the wiring of the even numbers and the wirings of the odd numbers are led out from the side surface of the supporting frame on the opposite side. Grid external terminals G1 to Gn are connected to the grid electrodes, respectively.

As described above, according to the present invention, phosphorus is contained within a range of 5 mol percent to 15 mol percent with respect to carbon in the deposited film containing carbon as a main component, so that the electron-emitting efficiency can be improved within a range where a serious influence is not exerted due to the aging change by driving.

What is claimed is:

1. An electron-emitting device comprising a pair of electroconductors disposed on a substrate so as to be opposite to each other and a pair of deposited films which are arranged so as to be connected to said pair of electroconductors, and which are disposed so as to sandwich a gap, and which contain carbon as a main component, wherein in said deposited film, phosphorus is contained within a range of 5 mol percent to 15 mol percent with respect to carbon.

2. An electron-emitting device comprising a pair of device electrodes arranged so as to be opposite to each other on a substrate, an electroconductive film which is arranged so as to be connected to said pair of device electrodes and which has a fissure between the pair of device electrodes, and a deposit which is formed in said fissure and a region including the fissure and which has a gap with a width that is narrower than the fissure in the fissure, wherein in said deposit, phosphorus is contained within a range of 5 mol percent to 15 mol percent with respect to carbon.

3. An electron source comprising a plurality of electron-emitting devices according to claim 1 or 2 on a substrate and wirings connected to said electron-emitting devices.

4. An image-forming apparatus comprising an electron source according to claim 3 and an image-forming member for forming images due to collision of electrons emitted from said electron source.

5. An electron-emitting device comprising:

a carbon film composed chiefly of carbon; and an electrode electrically connected to the carbon film, wherein phosphorus is contained in the carbon film in a ratio of 15 mol% or less with respect to carbon.

6. An electron-emitting device comprising:

a carbon film composed chiefly of carbon; and an electrode electrically connected to the carbon film, wherein phosphorus is contained in the carbon film in a ratio of from 5 mol% to 15 mol% with respect to carbon.

7. An electron-emitting device comprising:

a pair of electroconductors disposed on a substrate; and a pair of films connected to the pair of electroconductors, respectively, disposed with a gap therebetween and containing carbon as a main component, wherein phosphorus is contained in said films in a ratio of 15 mol% or less with respect to carbon.

8. An electron-emitting device comprising:

a pair of device electrodes disposed on a substrate;

electroconductive films connected to the pair of device electrodes and having a first gap between the pair of device electrodes; and a carbon film disposed in the first gap and on the electroconductive films, having a second gap narrower in width than that of the first gap, within the first gap, and containing carbon as a main component, wherein phosphorus is contained in the carbon film in a ratio of 15 mol% or less with respect to carbon.

9. An electron-emitting device comprising:

a pair of device electrodes disposed on a substrate so as to face each other;

electroconductive films connected to the pair of device electrodes and having a first gap between the pair of device electrodes; and a carbon film disposed in the first gap on the electroconductive films, having a second gap narrower in width than that of the first gap, within the first gap, and containing carbon as a main component, wherein phosphorus is contained in the carbon film in a ratio of from 5 mol% to 15 mol% with respect to carbon.

10. An electron source comprising a plurality of electron-emitting devices disposed on a substrate, and wirings connected to said electron-emitting devices, wherein each electron-emitting device is an electron-emitting device according to any one of claims 5 to 9.

11. An image-forming apparatus comprising an electron source according to claim 10, an image forming member.

12. An electron-emitting device comprising:

a carbon film composed chiefly of carbon; and an electrode electrically connected to the carbon film, wherein phosphorus is contained in the carbon film in a ratio of 5 mol% or more with respect to carbon.

13. An electron source comprising a plurality of electron-emitting devices disposed on a substrate, and wiring connected to said electron-emitting devices, wherein each electron-emitting device is an electron-emitting device according to claim 12.

14. An image-forming apparatus comprising an electron source according to claim 13, and a phosphor arranged to emit light in response to being irradiated with an electron emitted from said electron source.

15. An electron-emitting device comprising:

a deposit composed chiefly of carbon including a graphite structure; and an electrode electrically connected to the deposite, wherein phosphorus is contained in the deposit.

16. An electron source comprising a plurality of electron-emitting devices disposed on a substrate, and wirings connected to said electron-emitting devices, wherein each electron-emitting device is an electron-emitting device according to claim 15.

17. An image-forming apparatus comprising an electron source according to claim 16, and a phosphor arranged to emit light in response to being irradiated with an electron emitted from said electron source.

* * * * *

UNITED STATES PATENT AND TRADEMARK OFFICE

CERTIFICATE OF CORRECTION

PATENT NO. : 6,731,060 B1
DATED : May 4, 2004
INVENTOR(S) : Keisuke Yamamoto et al.

It is certified that error appears in the above-identified patent and that said Letters Patent is hereby corrected as shown below:

Title page,
Item [56], References Cited, FOREIGN PATENT DOCUMENTS,
"2854385" should read -- 2-854385 --.

Column 1,
Line 57, "No. 2854385" should read -- No. 2-854385 --.

Column 4,
Line 4, "electroconductors" should read -- electroconductor --.

Column 6,
Line 36, "1.3 x $10^{31\ 6}$ Pa," should read -- 1.3 x $10^{-6}$ Pa --.

Column 10,
Line 48, "deposite," should read -- deposit, --.

Signed and Sealed this

Twenty-first Day of September, 2004

JON W. DUDAS
*Director of the United States Patent and Trademark Office*